US011445882B1

(12) United States Patent
Feeny

(10) Patent No.: US 11,445,882 B1
(45) Date of Patent: Sep. 20, 2022

(54) DUST MOP HEAD FOR USE WITH MOP FRAMES INCLUDING BEVELED DUST MOP FRAME

(71) Applicant: The Tuway American Group, Inc., Troy, MI (US)

(72) Inventor: John Feeny, Troy, MI (US)

(73) Assignee: The Tuway American Group, Inc., Troy, MI (US)

( * ) Notice: Subject to any disclaimer, the term of this patent is extended or adjusted under 35 U.S.C. 154(b) by 0 days.

(21) Appl. No.: 16/133,270

(22) Filed: Sep. 17, 2018

Related U.S. Application Data

(60) Provisional application No. 62/559,593, filed on Sep. 17, 2017, provisional application No. 62/559,548, filed on Sep. 16, 2017.

(51) Int. Cl.

| | |
|---|---|
| ***A47L 13/255*** | (2006.01) |
| ***A47L 13/256*** | (2006.01) |
| ***A47L 13/254*** | (2006.01) |
| ***B25G 3/38*** | (2006.01) |

(52) U.S. Cl.
CPC ..... *A47L 13/255* (2013.01); *A47L 13/254* (2013.01); *A47L 13/256* (2013.01); *B25G 3/38* (2013.01)

(58) Field of Classification Search
CPC ..... A47L 13/20; A47L 13/254; A47L 13/255; A47L 13/256
See application file for complete search history.

(56) References Cited

U.S. PATENT DOCUMENTS

| | | | | |
|---|---|---|---|---|
| 4,225,998 | A | 10/1980 | Theilen | |
| 5,165,136 | A | 11/1992 | Moore | |
| 5,398,492 | A | 3/1995 | Thomas | |
| 5,740,578 | A | 4/1998 | Moore | |
| 8,776,300 | B2 * | 7/2014 | Colangelo | A47L 13/16 15/104.93 |
| D745,790 | S * | 12/2015 | Antonisami | D6/582 |
| 9,918,607 | B1 | 3/2018 | Lewis | |
| 2001/0029640 | A1 | 10/2001 | Cassar | |
| 2004/0055102 | A1 | 3/2004 | Treacy | |

* cited by examiner

*Primary Examiner* — Randall E Chin
(74) *Attorney, Agent, or Firm* — Young Basile Hanlon & MacFarlane, P.C.

(57) ABSTRACT

A dust mop frame that includes an elongate body member having a first elongate face and an opposed second elongate face. The elongate body member includes a central body region and at least one projection. The at least one projection has a first region that is connected to the planar central body region, a central region extending angularly outward from the first region at an orientation parallel to the longitudinal axis and an outer terminal edge. The outer terminal edge of the projection is oriented upward relative to the second elongate face of the central body region when the dust mop frame is in the use position. The dust mop also includes at least one handle attachment member connected to the first elongate face; and at least one mop head bundle attachment mechanism connected to the second elongate face.

20 Claims, 11 Drawing Sheets

DUST MOP HEAD FOR USE WITH MOP FRAMES INCLUDING BEVELED DUST MOP FRAME

The present application is a non-provisional application claiming priority to U.S. Provisional Application Ser. No. 62/559,593 filed Sep. 17, 2017, and U.S. Provisional Application Ser. No. 62/559,548, filed Sep. 16, 2017, the specifications of which is incorporated in their entirety herein.

BACKGROUND

This disclosure relates to dust mop heads. More particularly, dust tmop made of fibrous and/or yarn material that can be attached to a variety of frames including, but not limited to beveled dust mop frames to provide effective and efficient cleaning.

Dust mop frames have been employed to provide a mounting structure on which various dusting media can be attached. Dust mop frames provide various advantages, including but not limited to, increasing the width and breadth of a surface that can be cleaned on a given pass over dust mop head bundles having with less structural stiffness and providing a robust and effective connection between the mop head and the associated handle.

The need for dust mop frames have long been recognized and have resulted in many styles of dust mop frames and accessories. While such devices have been desirable, their ability to pick up dirt and dust have been limited. While rigid frame dust mop assemblies provide enhanced cleaning in certain situations, it has been found that dust mop frames and associated assemblies do not provide a configuration that maximizes cleaning action while stably maintaining the mop head in contact with the dust mop frame.

It has also been found that various microfiber and cloth dry dust mot heads do not efficiently and effectively collect dust and dirt as the dust and dirt tends to collect at leading edges of the dust mop head while inner areas of the mop head are under-utilized. It has also been found that where the dirt load to be cleaned includes large and small particles, the dust mop heads tend to collect a disproportionate quantity of larger particles while leaving the finer particles un-collected.

Thus, it would be desirable to provide a dust mop head that would more effectively collect high quantities of dust and particulate material. It is also desirable to provide frame and dust mop configuration that improves the cleaning ability of the associated mop head, while maintaining it in stable relationship with the dust mop frame. It would also be desirable to provide a dustmop frame which would allow for additional degrees of angles to redirect the position of the mop head when in use to further enhance the effectiveness of the cleaning apparatus

SUMMARY

Disclosed herein is a dust mop frame that includes an elongate body member. The elongate body member has a first elongate face and an opposed second elongate face. The elongate body member includes a central body region and at least one projection. The at least one projection has a first region that is connected to the planar central body region, a central region extending angularly outward from the first region at an orientation parallel to the longitudinal axis and an outer terminal edge. The outer terminal edge of the projection is oriented upward relative to the second elongate face of the central body region when the dust mop frame is in the use position. The dust mop also includes at least one handle attachment member connected to the first elongate face; and at least one mop head bundle attachment mechanism connected to the second elongate face.

Also disclosed is a mop head that includes the dust mop frame and at least one mop head bundle. The dust mop head bundle includes a body having a floor contacting region and at least one attachment mechanism, the attachment mechanism configured to engage the at least one mop head attachment mechanism on the dust mop frame.

Also disclosed is a dust mop head bundle that is an elongated fiber body having a central body.

These and other aspects of the present disclosure are disclosed in the following detailed description of the embodiments, the appended claims and the accompanying figures.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1A:
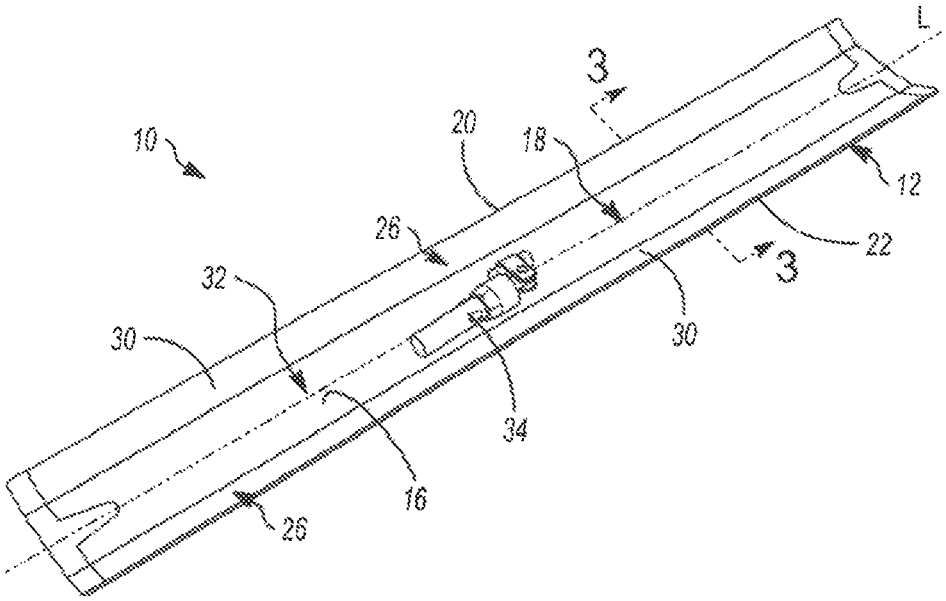
FIG. 1A is an upper perspective view of an embodiment of a dust mop frame as disclosed herein.

The present disclosure is directed to dust mop frames that can be mounted to a handle member either temporarily or permanently. The connection between the dust mop frame can be either fixed or one that accommodates the duct mop frame to pivot or swivel relative to the mop handle. The dust mop frame as disclosed herein in can accommodate one or more dust mop head bundles in attachment thereon such that the dust mop frame is interposed between at least a portion of the dust mop head bundle can the handle member. The dust mop head bundle can be either permanently attached to the dust mop frame, or can be detachable mounted thereto.

As disclosed, the dust mop frame includes an elongate body member which, in the use position, has a floor contacting face and a handle mounting device that is configured on the elongate body member at a location opposed to the floor contacting face. An embodiment of the dust mop frame as disclosed is depicted in FIGS. 1A and 1B.

Dust mop frame 10 includes an elongate body member 12 that has a first elongate face 14 and an opposed second elongate face 16. In FIG. 1, the first elongate face 14 is oriented toward a floor surface when the dust mop frame 10 is in the use position. The elongate body member 12 is composed of a central body region 18 and at least one projection 20 that extends outward from the central body region 18.

The elongate body member 12 can be constructed from a variety of materials including but not limited to various polymeric resins, metals, metal alloys and the like. It is contemplated that the material of choice will be one that will provide suitable rigidity for an associated mop head bundle (not shown). In the embodiment depicted, the elongate body member 12 is a solid body however various other configurations are considered to be with in the purview of this disclosure.

Figure 1B:
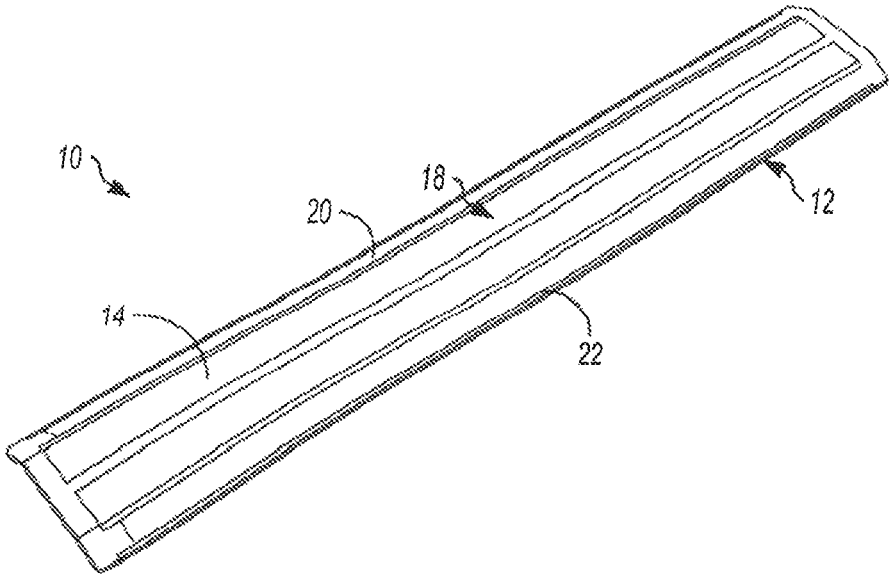
FIG. 1B is a lower perspective view of the dust mop frame of FIG. 1.
Figure 2:
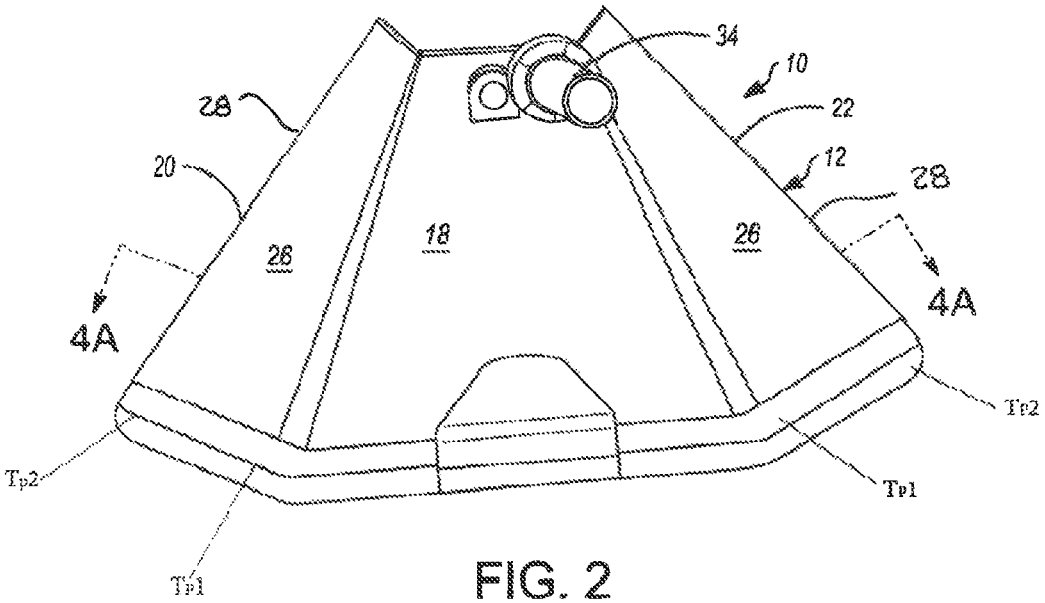
FIG. 2 is a side view of the dust mop frame of FIG. 1.

In the embodiment depicted in FIG. 1A, FIG. 1B and FIG. 2, two opposed projections 20 and 22 are contiguously connected to the central body region 18 and therefrom such that the central body region 18 is interposed between the opposed projections 20 and 22. The central body region 18 can be an elongate member. In certain embodiments, the central body region 18 will be configured as a rectangle such as the rectangular body depicted in the various drawing figures. The central body region 18 can have a longitudinal axis L extending therethrough. In the embodiment illustrated the central body region 18 includes two opposed side regions to which the two opposed projections 20 and 22 are each contiguously connected.

The at least one projection 20, 22 is oriented such that it is angled relative to the central body region 18. In various embodiments, the dust mop frame 10 can include two opposed projections 20,22 that are symmetrically disposed relative to a central or longitudinal axis L that extends through the central body region 18. In the embodiment depicted in FIGS. 1A and 1B and FIG. 2, the projections 20 and 22 are each configured as rectilinear members that have a consistent dimensions throughout their respective lengths. Other configurations are contemplated. In certain embodiments, the two opposed projections 20 and 22 can asymmetrical relative to one another. In certain embodiments, the dust mop frame 10 may have only one projection 20, if desired or required.

In the embodiment depicted in FIG. 1, the at least one projection 20, 22 has a first region that is contiguously connected to the central body region 18. The at least one projection 20, 22 also has a central region 26, 26 that is oriented parallel to the longitudinal axis L of the central body region 13 of the elongate body member 12. A terminal edge 28,28 is located opposite the respective first region. The terminal edge 28,28 can be configured as a generally straight edge region that is parallel to the longitudinal axis L in the longitudinal orientation as illustrated in FIG. 1. Alternately, the one or both terminal edges 28, 28 can be angled relative to the longitudinal axis L. It is also contemplated that one or more of the terminal edges 28, 28 can be have any suitable shape. Non-limiting examples of such shapes include edges that the curved, scalloped or have other configurations as desired or required.

Figure 3:
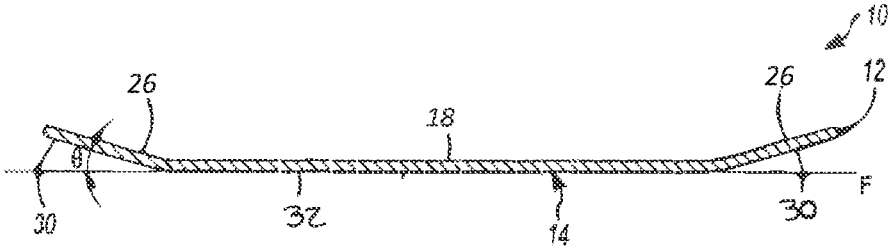
FIG. 3 is a cross-sectional view taken along the 3-3 line of FIG. 1.

As illustrated in FIG. 3, at least one projection 20, 22 has a face region 30, 30 that is contiguous to the respective localized face region 32 of the central body region 18. Together, these localized face regions 30, 30, 32 collectively from first elongate face 14 of dust mop frame 10. The respective face regions 30, 30 of projections 20, 22 are angled relative to the face region 32 of the central body region 18, such that the respective terminal edge 28, 28 of the respective projections 20, 22 is located at a position that is above the localized face region 32 of central body region 18 when the dust mop frame 10 is in the use position such as would occur when dust mop frame 10 is positioned on a floor surface F. The angle θ formed between face region 32 of central body region 18 and face region 30, 30 of the respective projection 20,22' can be an acute angle; with an angle θ between 10° and 75° being employed in certain embodiments. In certain embodiments, it is contemplated that the angle θ will be between 20° and 45°.

The central body region 18 can have any suitable thickness. In the embodiment depicted in FIG. 1, the central body region 18 is a generally planar member having a thickness $T_B$. The at least one projection 20, 22 can also have a generally planar configuration. In certain embodiments, the at least one projection 20, 22 can have a thickness $T_P$ that is generally equal to the thickness $T_B$ of the central body region 18 at the respective first region(s). The thickness of a the at least one projection 20, 22 can be consistent through the width $W_P$ of the associated projection 20, 22 or can taper from a thickness maximum $T_P$1 located proximate to the first region(s) to a lesser thickness $T_P$2 located proximate to terminal edge of the associated projection.

The dust mop frame 10 can also include at least one mop handle attachment member 34 that is connected to the elongate body member 12 of the dust mop frame 10. In the embodiment depicted in FIG. 1, the at least one mop handle attachment member 34 is connected to the second elongate face 16 of the elongate body member 12 of the dust mop frame 10. In certain embodiments, the mop handle attachment member 34 can be located on the elongate body member in a manner that facilitates movement of the dust mop frame 10 over the surface to be cleaned. In the embodiment illustrated, in various drawing figures, the mop handle attachment member 34 can be connected to elongate body member 12 in the central body region 18 of the dust mop frame 10. As broadly construed, the mop handle attachment member 34 can include least one device that is adapted to removably or permanently connect with a terminal end 39 of mop handle 36 to operatively connect the mop handle 36 to the dust mop frame 10. The mop handle 36 can have a variety of configurations, in certain embodiments, the mop handle 36 will be configured as an elongated dowel 41.

Figure 6A:
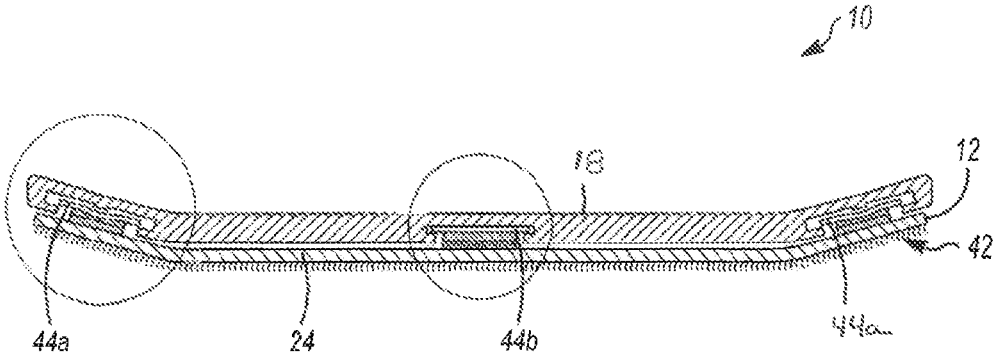
FIG. 6A is a cross sectional view of an embodiment of a dust mop frame as disclosed herein with a configuration of a dust mop head attached.
Figure 6B:
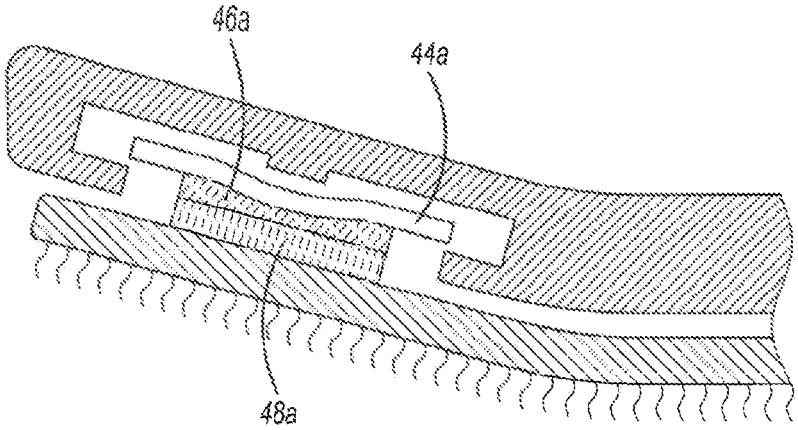
FIG. 6B is a detail view of an embodiment of a first connection point between the dust mop frame of FIG. 6A and a dust mop head.
Figure 6C:
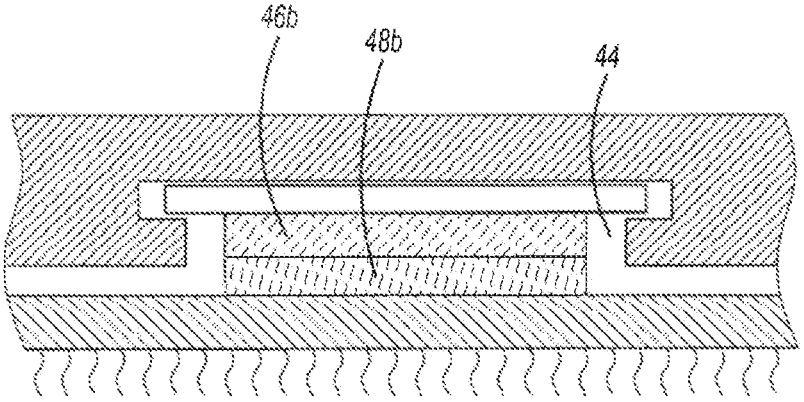
FIG. 6C is a detail view of an embodiment of second connection point between the dust mop frame of FIG. 6B.
Figure 7:
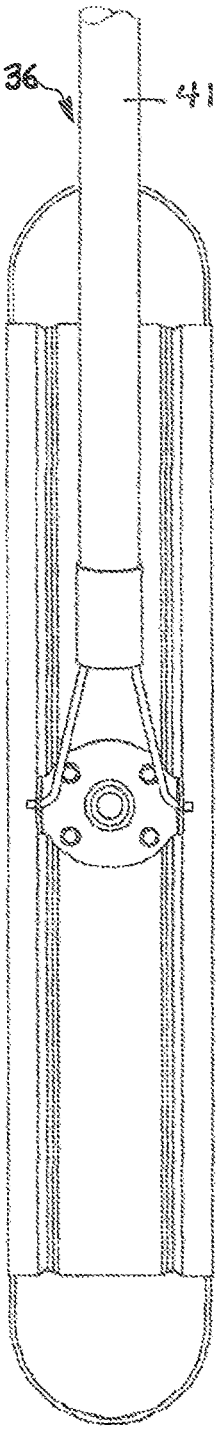
FIG. 7 is a top view of a third embodiment of a dust mop frame as disclosed herein with a mop handle attached thereto.
Figure 8:
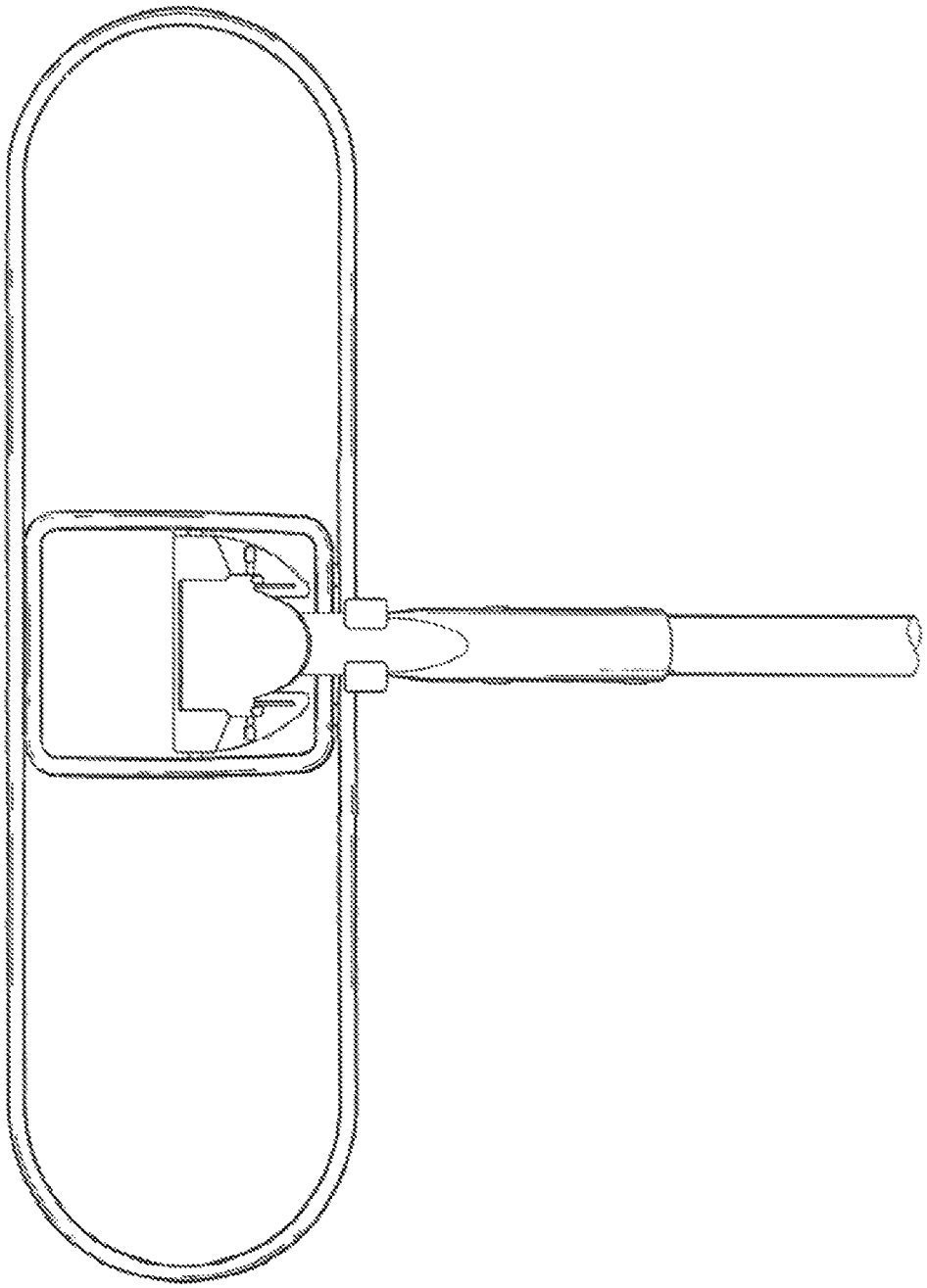
FIG. 8 is a top view of the dust mop frame of FIG. 7 with an alternate embodiment of a mop handle attachment mechanism.
Figure 9:
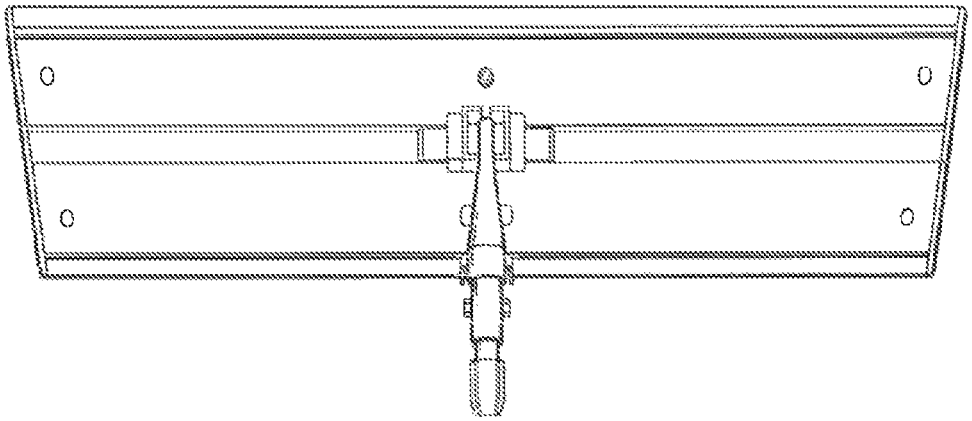
FIG. 9 is a top view of an alternate embodiment of an attachment device for the embodiment of the dust mop frame of FIG. 1.
Figure 10:
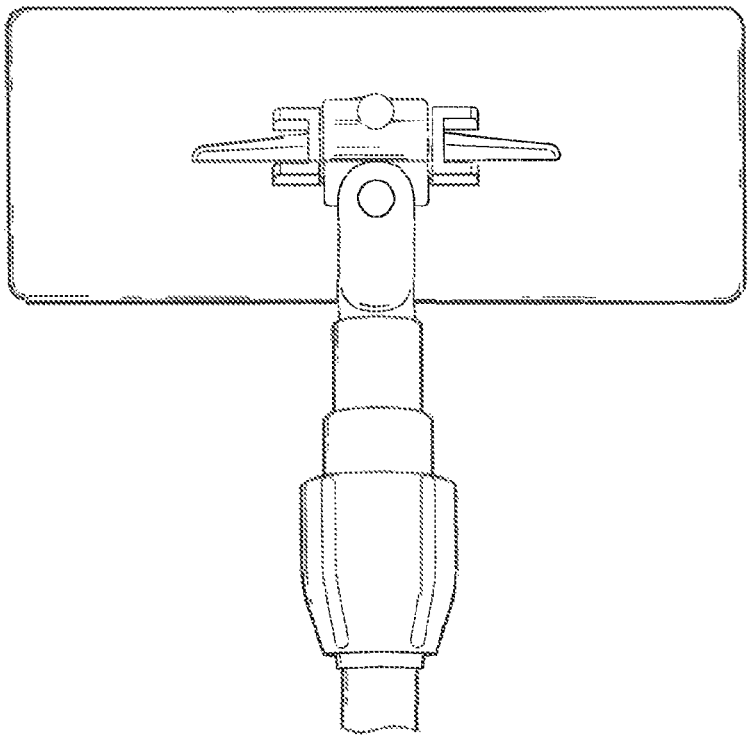
FIG. 10 is an alternate embodiment of an attachment mechanism that can be used with the device as disclosed herein.
Figure 11A:
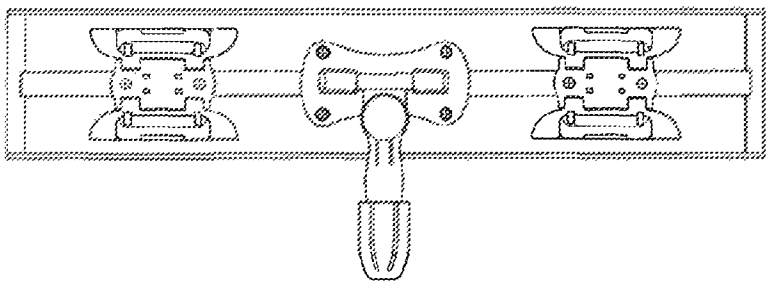
FIGS. 11A and 11B are top views of the dust mop frame of FIG. 1 with auxiliary attachment mechanisms mounted thereon.
Figure 11B:
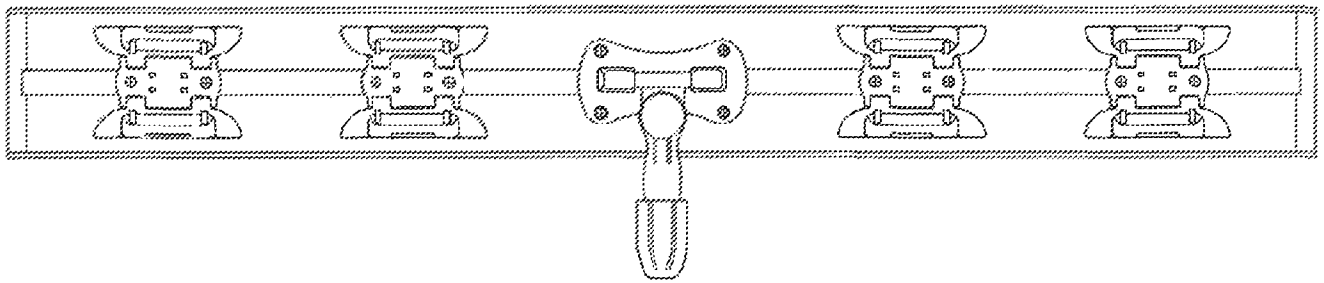
Figure 12:
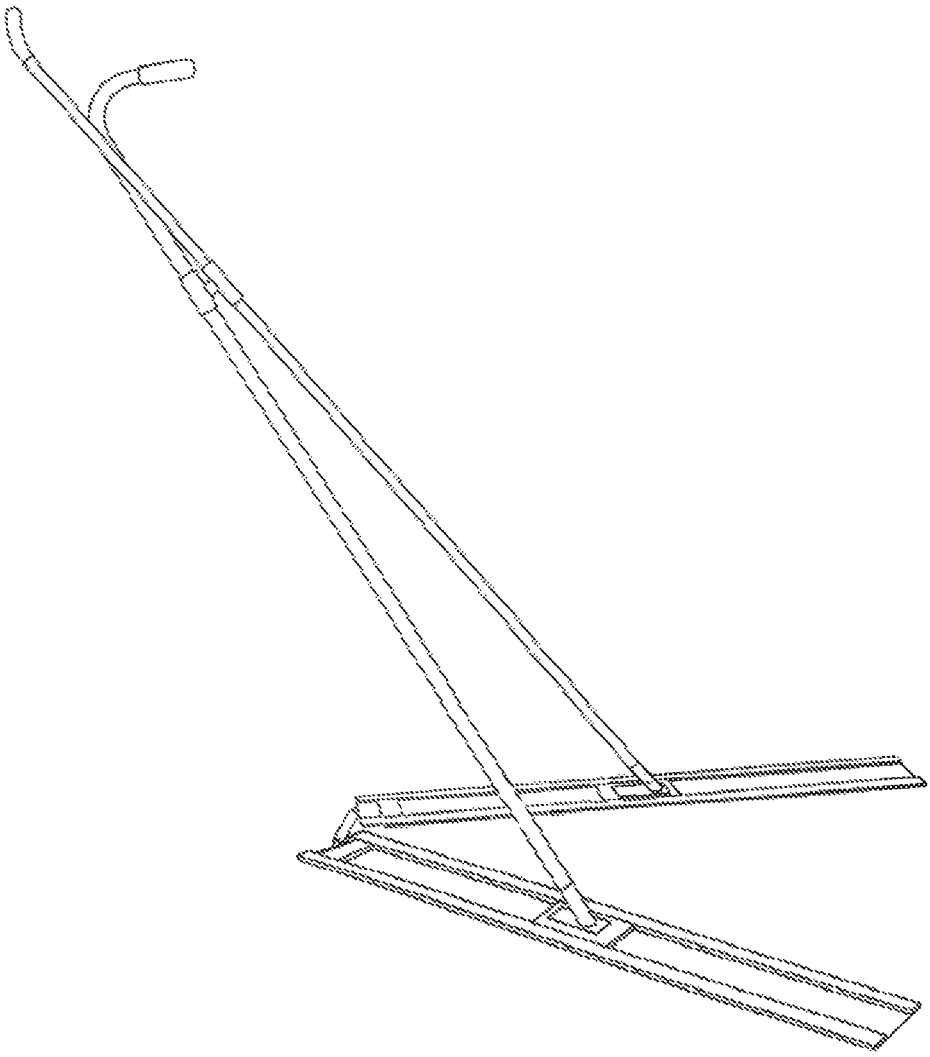
FIG. 12 is a mop device configured with multiple dust mop frames of FIG. 1.

One non-limiting example of such configuration is depicted in FIG. 6. Various embodiments of mop handle attachment member 34 will be discussed subsequently.

The dust mop frame 10 is configured to support a suitable surface cleaning member. The surface cleaning member can be configured as a mop head bundle such as dust mop head 42. The mop head bundle 42 can be connected to the dust mop frame 10 and can include at least one mop head bundle attachment mechanism 44. The at least one mop head bundle attachment mechanism 44 can be located at a position on elongated body member of the dust mop frame 10 suitable for the maintaining the mop head bundle 42 connected to the dust mop frame 10 in a suitable use position.

In various embodiments, a plurality of individual mop head bundle fastening mechanisms 44 are positioned at various locations on the first elongate face 14 of the dust mop frame 10. At least a portion of the mop head bundle fastening mechanisms 44 can be located in a suitable spaced relationship on the first elongate face 14. In certain embodiments, the mop head bundle attachment mechanism 44 can include hook and loop fastener members that can be mounted on the first elongate face 14 that can releasably engage the mop head bundle 42.

One non-limiting example of such a dust mop frame 10 configuration having hook and loop fastening mechanism 44*a*, 44*b* is depicted in FIG. 6A with one member 44*a*, 44*b* of the loop and hook fastening mechanism being affixed to the first elongate face 14 of the elongate body member 12 of the dust mop frame 10 and the mating member 46*a*, 46*b* being connected to the substrate of the mop head bundle 42. It is contemplated that various attachment mechanisms and devices can be employed in certain embodiments. Non-limiting examples of can be integral slide members, snaps or the like that can be employed to maintain the mop head bundle 42 in functional connection to the first elongate face 14 of the elongate body member 12 of the dust mop frame 10.

Figure 4A:
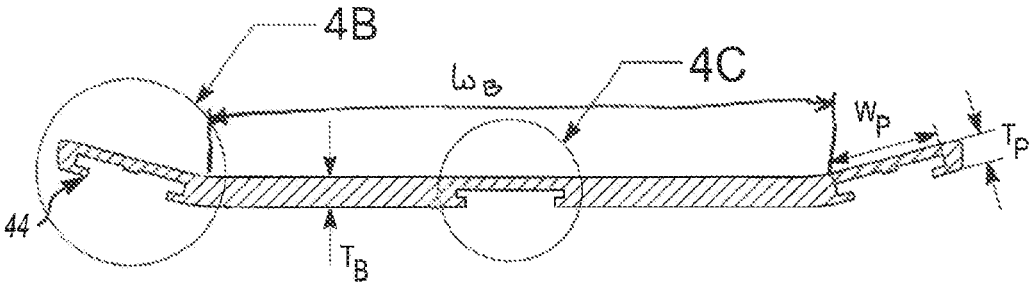
FIG. 4A is a cross sectional view taken along the 4-4 line of FIG. 2.
Figure 4B:
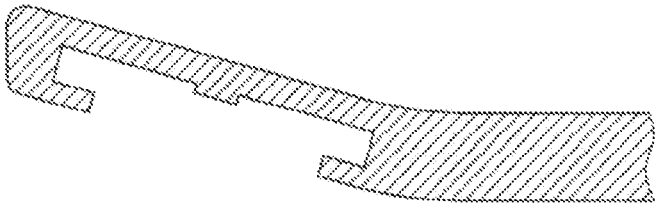
FIG. 4B is a detail view of a first embodiment of a slot member as depicted in FIG. 4A.
Figure 4C:
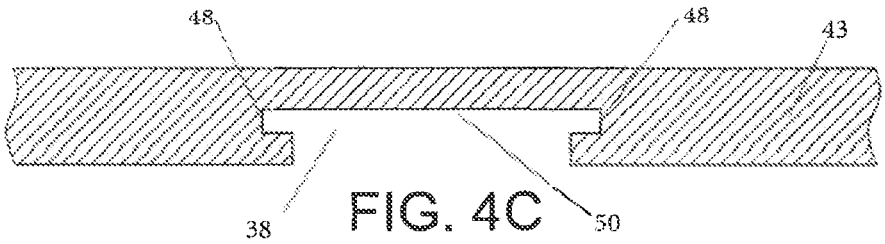
FIG. 4C is a detail view of a second embodiment of a slot member as depicted in FIG. 4A.
Figure 5:
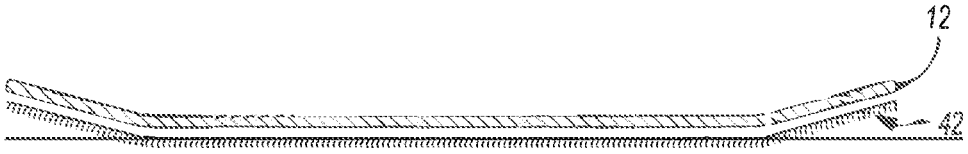
FIG. 5 is a cross sectional view of an embodiment of a dust mop frame as disclosed herein with a configuration of a dust mop head attached.

A specific embodiment of one mop head bundle fastening mechanism 44 used in the dust mop frame as disclosed is illustrated in FIGS. 4A, 4B and 4C. In the mop head bundle fastening mechanism 44 as illustrated, the first elongate face 14 of dust mop frame 10 can be configured with one or more slot detents such as slot 38 that project in from the surface of first elongate face 14 to contain one mating member 40*a* of a suitable fastening element. In certain embodiments, the mating member 40*a* can be a one element of a suitable hook and loop connecting member. Other types of mating fastener elements can be employed as desired or required.

Referring now to FIGS. 1B, 4B and 4C, slot 38 is defined in the first elongate face 14 of the elongate body member 12 to extend into a central interior region 43. The slot 38 includes opposed side walls 48 that are each contiguously connected to base wall 50. In the embodiment depicted, a mating member 40*a* of the suitable fastening element can be affixed the base wall 46 with the respective fastening element 40*a* facing outward from the defined slot 38. Slot 38 will have a depth suitable to accommodate the fastening element 40*a* therein.

Figure 13:
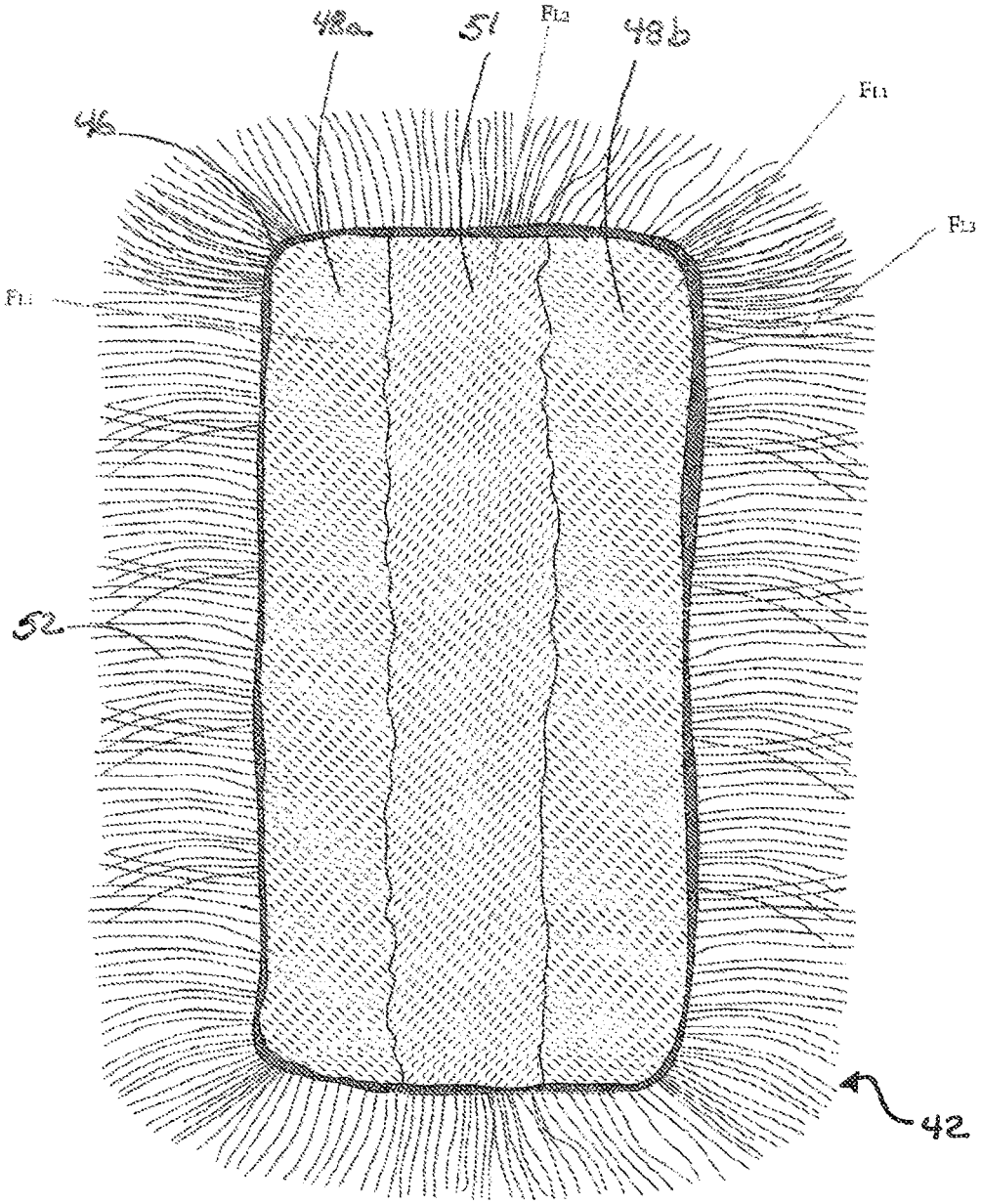
FIG. 13 is a plan view of an embodiment of the mop head as disclosed herein.

As illustrated in the embodiment depicted in FIG. 13, the mop head bundle 42 can be made of an elongate planar central body 46 composed of one or more materials including but not limited to woven and non-woven fabric sheet stock, yarn or tufted materials, etc., connected to a suitable base 24 (see FIG. 6A). The mop head material can be composed of one or more of a variety of synthetic or natural materials as well as combinations of the two. Where desired or required, the material of the mop head bundle 42 can be composed a washable reusable material. It is also contemplated that mop head bundle can be composed of disposable material where desired or required. in certain embodiments, the mop head bundle 42 can be configured with pile or tuft regions of varying height on different regions of the mop head bundle 42.

The central body 46 can have a longitudinal axis L and define an interior region and an outer perimeter. The central body having a length L and a width W wherein the length L is greater than the width W. The central body has a first longitudinal face configured to releasably contact a mop frame such as mop frame 10 and a second face opposed to the first face, the second face configured to operatively contact a floor surface, the second face including a pair of fabric strips such as pile regions 48*a* and 48*b* having a hairy fiber surface such as outer fringe 52, the hairy fibers having a fiber length $F_{L1}$, the pair of fabric strips disposed parallel to the longitudinal axis in spaced relation from one another, and an intermediate strip such as region 51, the intermediate strip having a fine twist pile, the fine twist pile having a fiber length $F_{L2}$, wherein $F_{L1}$ is less than $F_{L1}$.

In certain embodiments, the mop head bundle 42 can include at least two different pile regions as the at least two hairy surfaces. In the embodiment as illustrated in FIG. 13, the mop head bundle 42 includes three pile regions 48*a*, 48*b* and 51 oriented in parallel relationship to one another with pile regions 48*a* and 48*b* being composed of the same or similar pile material and pile region 51 being composed of a different pile. The differences in respective piles can be due to one or more of the following characteristics: material of construction, pile density, pile length, fiber thickness, yarn construction, cut or loop characteristics and the like. Where desired or required, the pile can be cut pile or loop pile. It is also contemplated that the material can be a woven or felted material have a weave suitable to retain dust dirt or the like.

The mop head 42 also includes an outer fringe 52 connected to the outer perimeter of the elongate planar central body, the outer fringe composed of a plurality of yarn fibers having a a fiber length $F_{L3}$, wherein $F_{L3}$ is greater than $F_{L2}$.

The outer fringe 52 can be composed of one or more rows of yarn fibers if desired or required can include at least one row of heat set yarn that can be configured as cut fringe.

In certain embodiments it is contemplated that the pile or tuft regions can be deeper, i.e. the average length of the fibers composing the region can be longer. While other regions can be configured with a shorter pile configuration. In the embodiment depicted in FIG. 13, pile regions 48*a* and 48*b* are associated with the respective projections 20, 22 when the mop head is in the use position, while pile region 51 is associated with the central body region 18. Without being bound to any theory, it has been discovered that configuring regions such as 48*a* and/or 48*b* that are associated with upwardly oriented projections such as projections 20, 22 with a pile region having an average lower pile than that employed in pile region 51 and associated with the central body region 18 a mop frame such as mop frame 10 provides unexpected efficiency at collecting and isolated dust and dirt over flat mops as well as contoured mops employing unitary pile material. Where the pile regions differ in pile height, it is contemptible that the difference between central regions such as pile region 51 and side regions such as pile regions 48*a* and 48*b* will be between 10% and 50%, with differences between 10% and 30% in certain embodiments. It is also with in the purview of this disclosure to configure pile regions 48*a* and 48*b* with piles of different characteristics if desired or required.

It is also contemplated that one or more regions located one mop bundle 42 associated with the central body region 18 of the dust mop frame 10 can be configured with material that can aid in agitation of dirt material present on the surface to be cleaned. In certain embodiments, the agitation regions can be configured with material of greater stiffness than the surrounding regions. The material in the one or more agitation regions can be composed of bristle like material where desired or required. Where employed the stiffer material can be interspersed in some or all of the pile that composes a specific pile region. In certain embodiments, regions of stiff material will be located in pile region 51.

Where desired or required, the central pile region 51 can have compose between 30 to 50% of the area of the central region 46.

In certain embodiments, the region of the mop head bundle 42 associated with the central body region 18 can be a woven material, a pile or tufted material or a combination of the two. Where pile is employed in the region of the mop head bundle 42 associated with the central body region 18 of the dust mop frame 10, it is contemplated that the pile will have an average height between 0.2 inches and 2 inches.

In certain embodiments, it is contemplated that the region (s) of the mop head bundle 42 that is associated with the respective projections 20, 22 of the dust mop frame can have length and/or density value(s) to effectively collect and maintain dust and dirt that initially comes in contact with the dust mop frame 10 in regions associated with the leading edge(s) 28. In certain embodiments, it is contemplated that the pile employed in the region(s) of the mop head bundle 42 associated with the respective projections 20, 22 of the dust mop frame 10 can be equipped with a pile region having a thickness and/or density that differs from that of the pile present in the region of the mop head bundle 42 associated with the central region 18 of the dust mop frame 10. In certain embodiments, the pile located in regions of the mop head bundle 42 that is associated with the respective projections 20, 22 can have a thickness and/or density and or length that is great than pile located in other regions of the mop head bundle 42.

Dust mop frames can also include means for connecting the dust mop frame to the handle member as well as means or devices to connect the mop head member to the frame. The dust mop frames that have been proposed have a generally elongated body that provides a flat planar lower surface configured to maximize the contact area between the associated mop head with the floor to be mopped.

While the invention has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A dust mop head bundle comprising:

an elongate planar central body having a longitudinal axis, the elongate planar central body having an interior region and an outer perimeter, the central body having a length L and a width W wherein the length Lis greater than the width W, the central body having a first longitudinal face configured to releasably contact a mop frame and a second face opposed to the first face, the second face configured to operatively contact a floor surface, the second face including a pair of pile regions having a fiber length $F_{L1}$, the pair of pile regions disposed parallel to the longitudinal axis in spaced relation from one another, and an intermediate pile region interposed between the pair of pile regions, the intermediate pile region having a fine twist pile, the fine twist pile having a fiber length $F_{L2}$, wherein $F_{L2}$ is less than $F_{L1}$; and an outer fringe connected to the outer perimeter of the elongate planar central body, the outer fringe composed of a plurality of yarn fibers having a fiber length $F_{L3}$, wherein $F_{L3}$ is greater than $F_{L2}$.

2. The dust mop head bundle of claim 1 wherein the yarn fibers of the outer fringe are oriented in at least one row.

3. The dust mop head bundle of claim 2 wherein the yarn fibers of the outer fringe are formed as a cut fringe composed of heat set yarn.

4. The dust mop head bundle of claim 1 wherein the intermediate strip of the second face of the elongate planar central body has a width that is equal to between 10% and 50% of the width W.

5. The dust mop head bundle of claim 4 wherein the intermediate strip of the second face of the elongate planar central body has a width that is equal to between 20% and 40% of the width W.

6. A dust mop configuration comprising:

a dust mop frame, the dust mop frame comprising:

an elongate body member, the elongate body member having a first elongate face and a second elongate face opposed to the first elongate face, the elongate body member including a central body region having a length and defining a longitudinal axis and a width transverse to the longitudinal axis, the central body region having a first central body face and an opposed second central body face, and two projections each projection having a first region connected to the central body region, a central region extending angularly outward from the first region connected to the first region at an orientation parallel to the longitudinal axis of the central body region and an outer terminal edge, wherein the outer terminal edge is oriented upward relative to the first central body face when the dust mop frame is in a use position;

at least one handle attachment member connected to the second elongate face of the elongate body; and at least one mop head bundle removably attached to the dust mop frame, the mop head bundle comprising:

an elongate planar central body having a longitudinal axis, the elongate planar central body have an interior region and an outer perimeter, the central body having a length Land a width W wherein the length Lis greater than the width W correspond to a length and a width defined by the dust mop frame, the central body having a first longitudinal face configured to releasably contact the dust mop frame and a second face opposed to the first face, the second face configured to operatively contact a floor surface, the second face including a pair of pile regions, the two respective pile regions corresponding to the two projections defined in the elongate body of the central body, the pair of pile regions each having fiber length $F_{L1}$, the pile regions disposed parallel to the longitudinal axis in spaced relation from one another, and an intermediate strip, an intermediate pile region corresponding to the central body of the frame, the intermediate pile region having a fine twist pile, the fine twist pile having a fiber length $F_{L2}$, wherein $F_{L2}$ is less than $F_{L1}$; and an outer fringe connected to the outer perimeter of the elongate planar central body, the outer fringe composed of a plurality of yarn fibers having a fiber length $F_{L3}$, wherein $F_{L3}$ is greater than $F_{L2}$.

7. The dust mop configuration of claim 6 wherein the central body region of the dust mop frame is planar.

8. The dust mop configuration of claim 6 wherein the at least one projection of the dust mop frame has a projection length, wherein the projection length is equal to the length of the central body region.

9. The dust mop configuration of claim 8 wherein the at least one projection forms an angle with the central body region and wherein the angle that has a value between 100° and 175° as measured from the second central body face and the central region of the at least one projection.

10. The dust mop configuration of claim 9 wherein dust mop frame angle has a value between 145° and 170°.

11. The dust mop configuration of claim 6 wherein the central body has a width $W_B$ and the at least one projection has a width $W_P$ wherein $W_P$ is less than $W_B$.

12. The dust mop configuration of claim 11 wherein $W_P$ has a value that is between 10% and 70% of $W_B$.

13. The dust mop configuration of claim 6 further comprising at least one mop head bundle, the mop head bundle comprising a substrate having a first face and an opposed second face, the substrate having dimensions sufficient to overlay at least a portion of the first elongate face of the elongate body member, wherein the first face of the substrate is proximate to the first elongate face of the elongate body member and the second face of the substrate member has a debris collecting surface.

14. The dust mop configuration of claim 6 wherein at least a portion of the dust collecting surface of the second face of the substrate member is composed of a plurality of tufts projecting outward from the second face of the substrate member to at least one length.

15. The dust mop configuration of claim 14 wherein the tufts located proximate to the at least one projection is longer than tufts located proximate to the central body region.

16. The dust mop configuration of claim 6 wherein the central body member of the elongate body member is planar and defines a longitudinal axis and a width $W_B$ transverse to the longitudinal axis and wherein each of the two projections has a width $W_P$ that is less than $W_B$ wherein the central body region is positioned between the at least two projections.

17. The dust mop configuration of claim 16 wherein the width $W_P$ of at least one of the two projections has a value between 10% and 70% of $W_B$.

18. The dust mop configuration of claim 16 wherein the at least one of the projection forms an angle with the central body region and wherein the angle that has a value between 100° and 175° as measured from the second central body face and the central region of the at least one of the projection.

19. The dust mop configuration of claim 16, wherein the mop head bundle further comprises a substrate having a first face and an opposed second face, the substrate having dimensions sufficient to overlay at least a portion of the first elongate face of the elongate body member, wherein the first face of the substrate is proximate to the first elongate face of the elongate body member and the second face of the substrate member has a debris collecting surface.

20. The dust mop configuration of claim 19 wherein at least a portion of the debris collecting surface of the pair of pile regions located on the second face of the substrate member are composed of a plurality of tufts projecting outward from the second face of the substrate member to at least one length, and wherein at least a portion of the debris collecting surface of the central body region is composed of a plurality of tufts, wherein the tufts located in the pair of pile regions are longer than the tufts located proximate to the central body region.

* * * * *